US009708095B2

(12) United States Patent
Rosselli

(10) Patent No.: US 9,708,095 B2
(45) Date of Patent: Jul. 18, 2017

(54) DEVICE AND METHOD FOR PACKAGING OF THIN BODY CONTAINERS, AND LOADING GROUP OF SAID CONTAINERS

(75) Inventor: Lorenzo Rosselli, Alessandria (IT)

(73) Assignee: GUALA PACK S.p.A., Castellazzo Bormida (IT)

( * ) Notice: Subject to any disclaimer, the term of this patent is extended or adjusted under 35 U.S.C. 154(b) by 980 days.

(21) Appl. No.: 13/817,618

(22) PCT Filed: Aug. 5, 2011

(86) PCT No.: PCT/IB2011/053501

§ 371 (c)(1),
(2), (4) Date: Feb. 19, 2013

(87) PCT Pub. No.: WO2012/028980

PCT Pub. Date: Mar. 8, 2012

(65) Prior Publication Data

US 2013/0160399 A1 Jun. 27, 2013

(30) Foreign Application Priority Data

Sep. 1, 2010 (IT) ..... BS2010A0148

(51) Int. Cl.

| | |
|---|---|
| ***B65B 5/06*** | (2006.01) |
| ***B65D 5/50*** | (2006.01) |
| ***B65B 35/58*** | (2006.01) |
| ***B65B 43/44*** | (2006.01) |
| *B65B 43/14* | (2006.01) |
| *B65B 35/56* | (2006.01) |
| *B65B 43/42* | (2006.01) |

(Continued)

(52) U.S. Cl.

CPC ..... *B65D 5/5052* (2013.01); *B65B 5/06* (2013.01); *B65B 35/58* (2013.01); *B65B 43/44* (2013.01)

(58) Field of Classification Search

CPC ..... B65B 35/56; B65B 35/58; B65B 43/14; B65B 43/44

USPC ..... 53/446, 542, 544, 142–144; 414/404, 414/416.04, 811, 27, 791.7, 791.8, 792, 414/792.2, 792.3, 792.5; 198/398, 401, 198/412, 414

See application file for complete search history.

(56) References Cited

U.S. PATENT DOCUMENTS

| | | | | |
|---|---|---|---|---|
| D552,483 | S | 10/2007 | Rigardo | |
| 2002/0060136 | A1 * | 5/2002 | Hiramoto et al. | 198/678.1 |

FOREIGN PATENT DOCUMENTS

| | | | |
|---|---|---|---|
| EP | 1 201 546 | A1 | 5/2002 |
| EP | 1 538 105 | A1 | 6/2005 |
| GB | 2194507 | A * | 3/1988 |

(Continued)

OTHER PUBLICATIONS

International Application and Written Opinion for PCT/IB2011/053501, mailed Nov. 21, 2011; ISA/EP.

*Primary Examiner* — Hemant M Desai
*Assistant Examiner* — Valentin Neacsu
(74) *Attorney, Agent, or Firm* — Harness, Dickey & Pierce, P.L.C.

(57) ABSTRACT

A device for packaging thin body containers comprises transport means, a tip-up unit (21), auxiliary guides (30), an unloading zone (58) and movement means suitable for cooperating with the tip-up unit (21) in the unloading configuration and with the auxiliary guides in the active configuration, to move the containers towards the unloading area (58).

11 Claims, 9 Drawing Sheets

(51) Int. Cl.
*B65B 43/48* (2006.01)
*B65B 43/46* (2006.01)

(56) References Cited

FOREIGN PATENT DOCUMENTS

| | | | |
|---|---|---|---|
| JP | 5 170252 | A | 7/1993 |
| WO | WO-2008050361 | A1 | 5/2008 |

* cited by examiner 55
10
19
22
52
30
U
21
42
B
A,D
A,D
B
58
64
66
C
V
60
68
62

DEVICE AND METHOD FOR PACKAGING OF THIN BODY CONTAINERS, AND LOADING GROUP OF SAID CONTAINERS

CROSS-REFERENCE TO RELATED APPLICATIONS

This application is a 371 U.S. National Stage of International Application No. PCT/IB2011/053501, filed Aug. 5, 2011, and claims priority to Italian patent application No. BS2010A000148, filed Sep. 1, 2010, the disclosures of which are herein incorporated by reference in their entirety.

FIELD

The present disclosure relates to a device and method for packaging thin wall containers, in particular flexible containers, such as those for containing dense fluids such as creams, yoghurt, honey, fruit juices, medicines and the like.

BACKGROUND

It is known that for technological reasons, containers, especially for use with foodstuffs, are manufactured by a first company and then packaged and transported to the company producing the dense fluid, where they are filled and sealed.

The logistic costs of the containers significantly influence the overall cost of supplying the product.

SUMMARY

The purpose of the present invention is to realise a device and method for packaging thin body containers, which significantly reduces transport costs.

The characteristics and advantages of the invention will be evident from the description given below, made by way of a non-limiting example.

DRAWINGS

FIG. 1 shows a ground view diagram of a production and packaging apparatus of thin body containers;

FIGS. 2*a* to 2*e* show a functioning sequence of a packaging device of the apparatus in FIG. 1;

DETAILED DESCRIPTION

Figure 1:
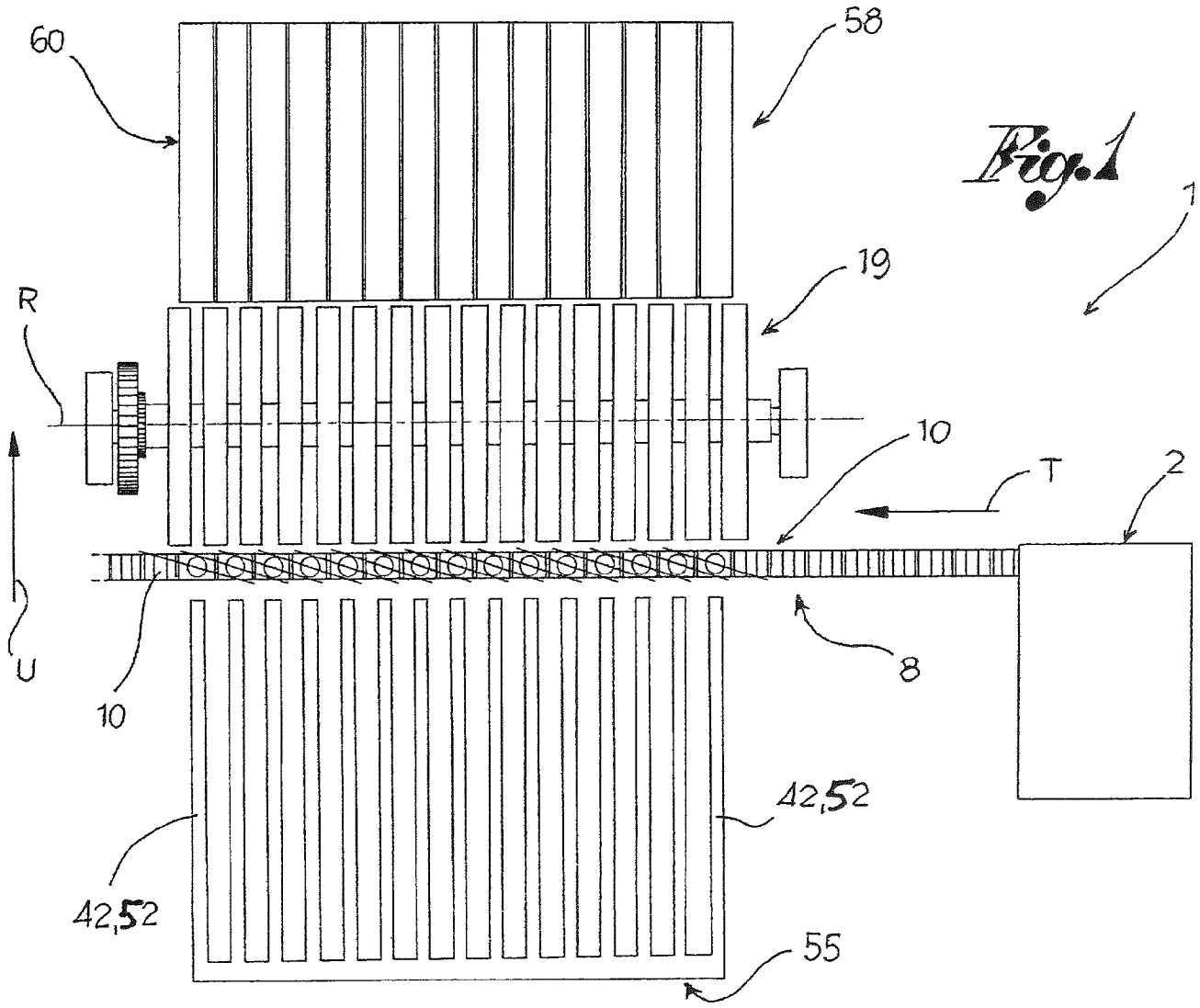

Example In accordance with the appended drawings, reference numeral 1 globally denotes a production and packaging apparatus of thin wall containers, as shown in FIG. 1.

In particular, the apparatus is suitable to produce and package containers C, as shown in FIGS. 2*a*-2*e*, consisting of a body B formed of two more walls of flexible film, facing one another and joined, for example welded along the edges, if required with gusset bags, and provided with a straw A of rigid material, fitted in a section of the edge of the body B, usually between the side walls. Sometimes, the straw A is coupled to a cap D, also of rigid material.

One embodiment example of such containers is shown in documents EP-A1-1538105 and US-D-552,483, in the Applicant's name; one embodiment example of a straw with cap is shown in the document WO-A1-2008-050361, also in the Applicant's name.

Referring to FIG. 1, the apparatus 1 comprises a production device 2 suitable to produce the containers C to be packaged; the production device 2 provides the containers C to be packaged in a predefined arrangement.

Figure 2A:
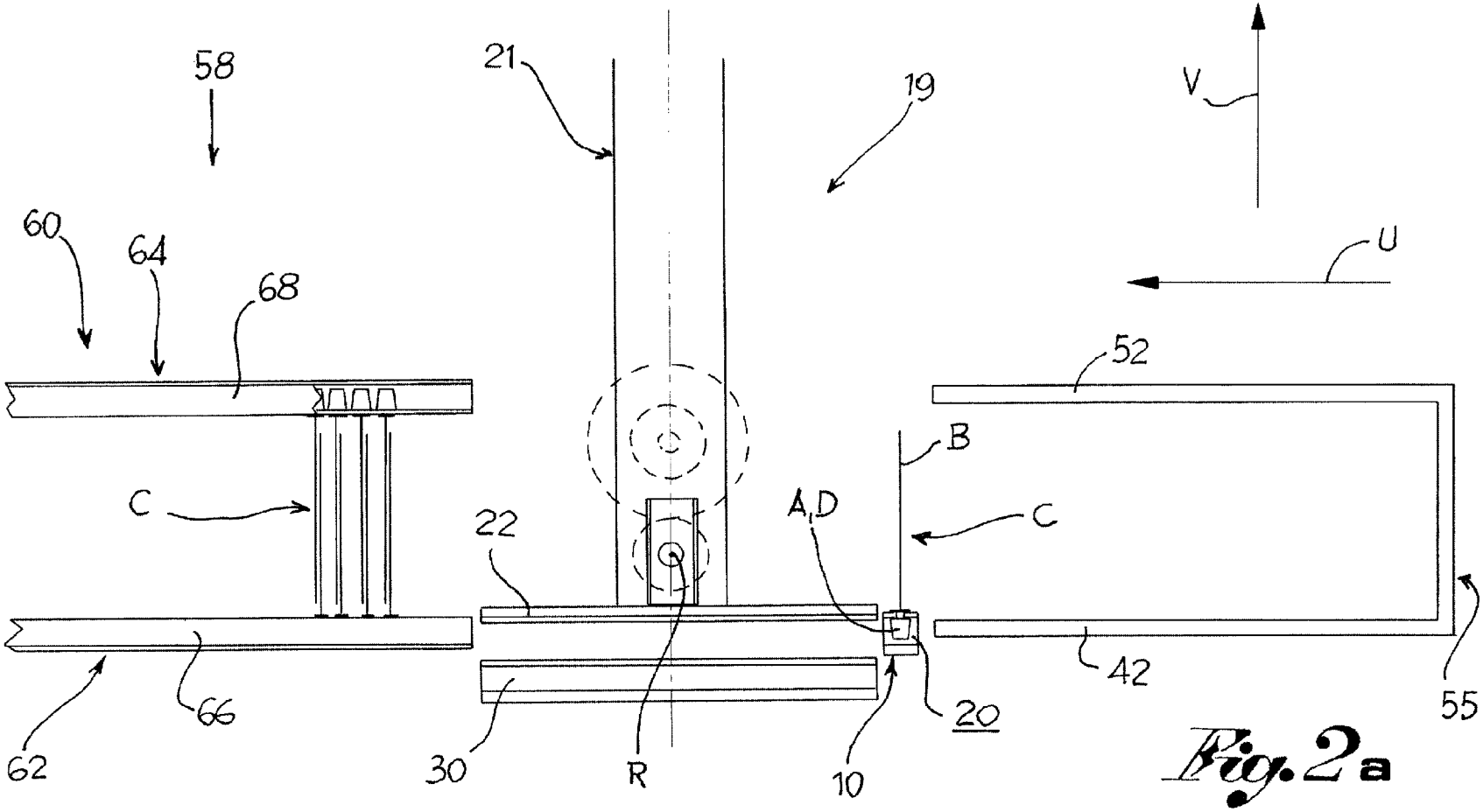

For example, the containers C to be packaged are provided in rows and upside-down, that is with the straw facing downwards and the flexible body facing upwards, as shown in FIG. 2*a*.

The apparatus 1 further comprises a packaging device suitable to package the containers C and transport means for the transport of the containers C from the production device 2 to the packaging device.

For example, as shown in FIG. 1, the transport means comprise a chain 8 able to translate along a transport direction (T); the chain 8 forms a closed outward (from the production device to the packaging device) and return circuit (from the packaging device to the production device).

Figure 3:
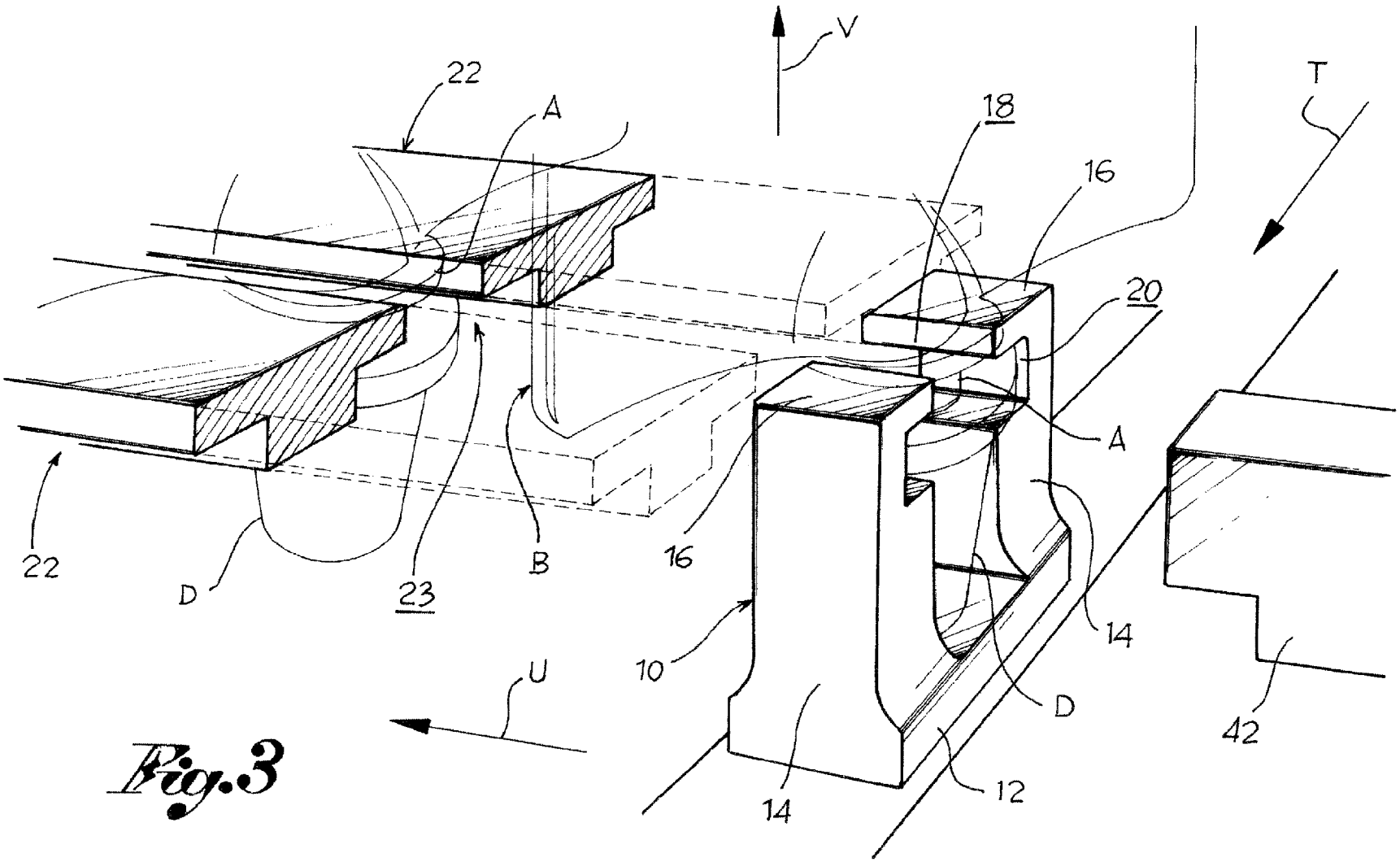
FIG. 3 shows a detail of the packaging device, and in particular a diagram of a loading unit of a chain, of a lower pusher and of tracks in the loading configuration.
Figure 4:
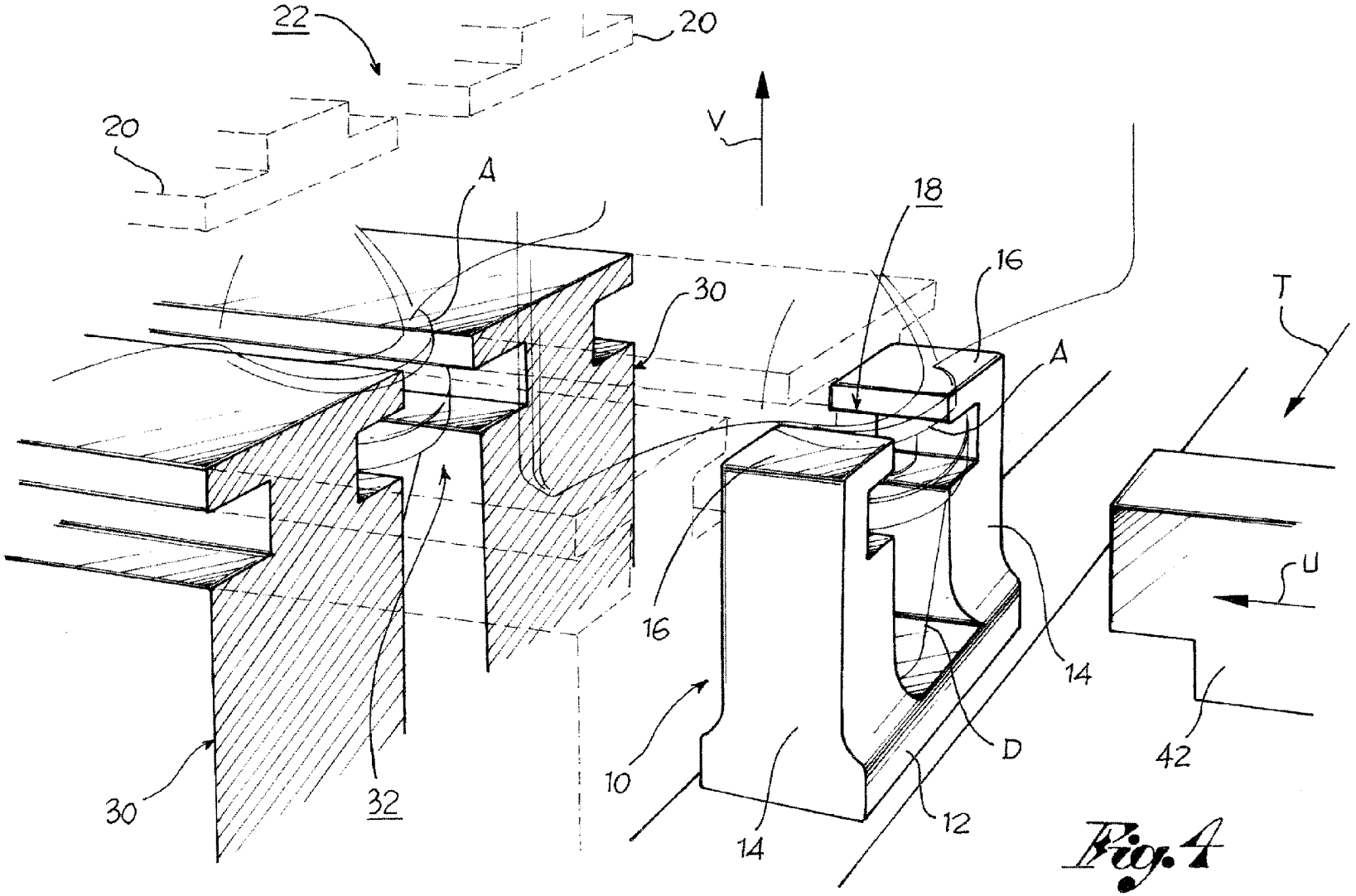
FIG. 4 shows a further detail of the packaging device, and in particular a diagram of the loading unit of the chain, of the lower pusher and of auxiliary guides in the position of the active configuration.
Figure 5:
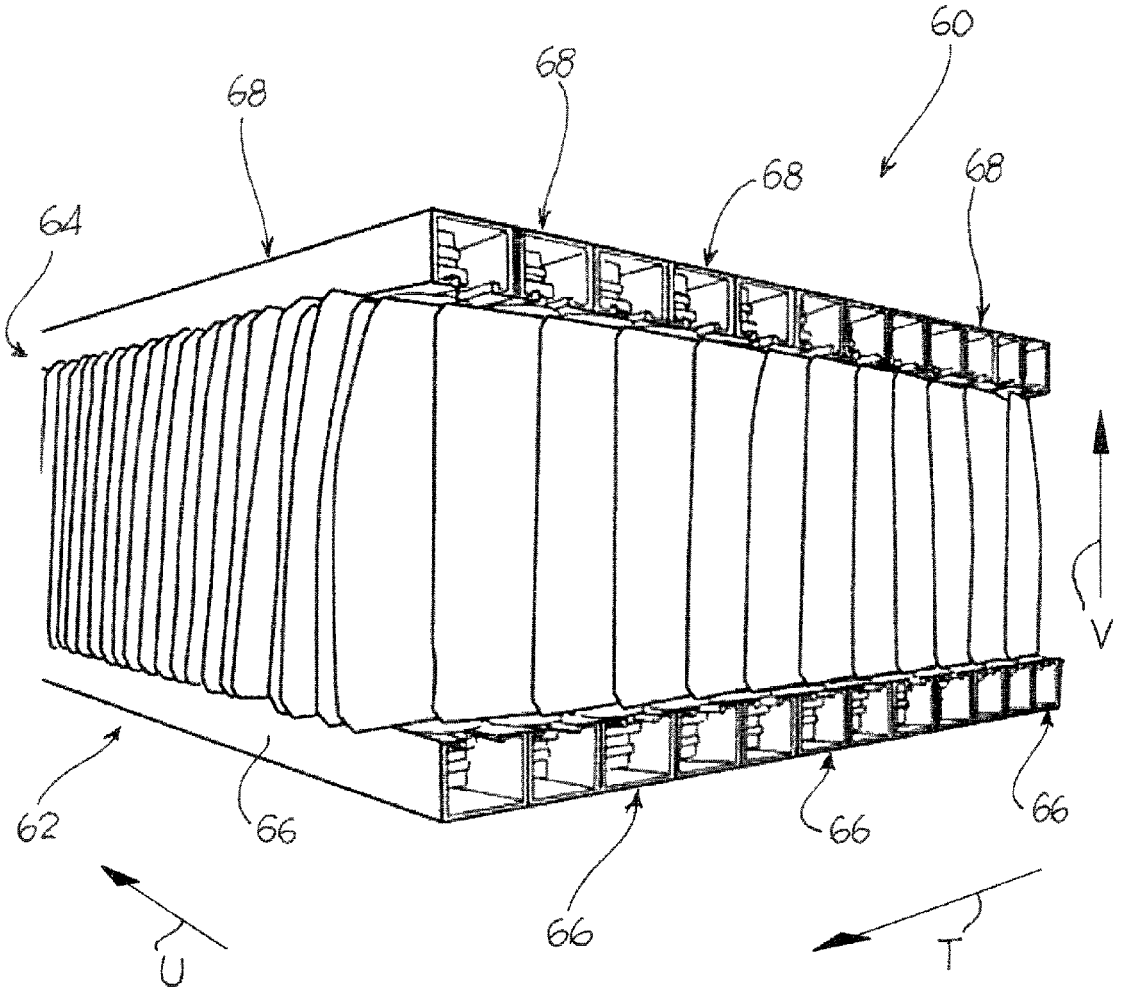
FIG. 5 shows a loading group according to the present disclosure.

The chain 8 comprises a plurality of loading units 10, shown in detail in FIGS. 3 and 4, aligned along a transport direction T and hinged to each other. For example, each loading unit 10 is suitable to transport one container C.

According to an embodiment, the longitudinal cross-section of a loading unit 10, that is the cross-section made with a plane containing the transport direction T, is a "U" shape to permit the sliding of the containers C in an unloading direction U, orthogonal to the transport direction T.

According to an embodiment and as shown in FIGS. 3 and 4, the loading unit 10 has a base 12, sides 14 projecting from the extremities of the base 12 and tabs 16, connected to the extremities of the sides and converging with each other so as to leave a sliding passage 18 open and define a loading compartment 20.

The container C, in the loading unit 10, is positioned vertically, that is in a vertical direction V (orthogonal to the transport direction T and to the unloading direction U). Moreover, the container C is positioned upside-down, that is with the straw A facing downwards and the body upwards, as shown in FIG. 2*a*.

In particular, the straw A is partially housed in the loading compartment 20; a section of the straw A traverses the passage 18 and the body B is rather positioned on the outside of the loading unit 10.

The packaging device comprises an intermediate station 19, as shown in FIGS. 2*a*-2*e*, alongside the chain 8 for the transfer of the containers from the chain to the intermediate station by pushing and sliding.

Figure 2B:
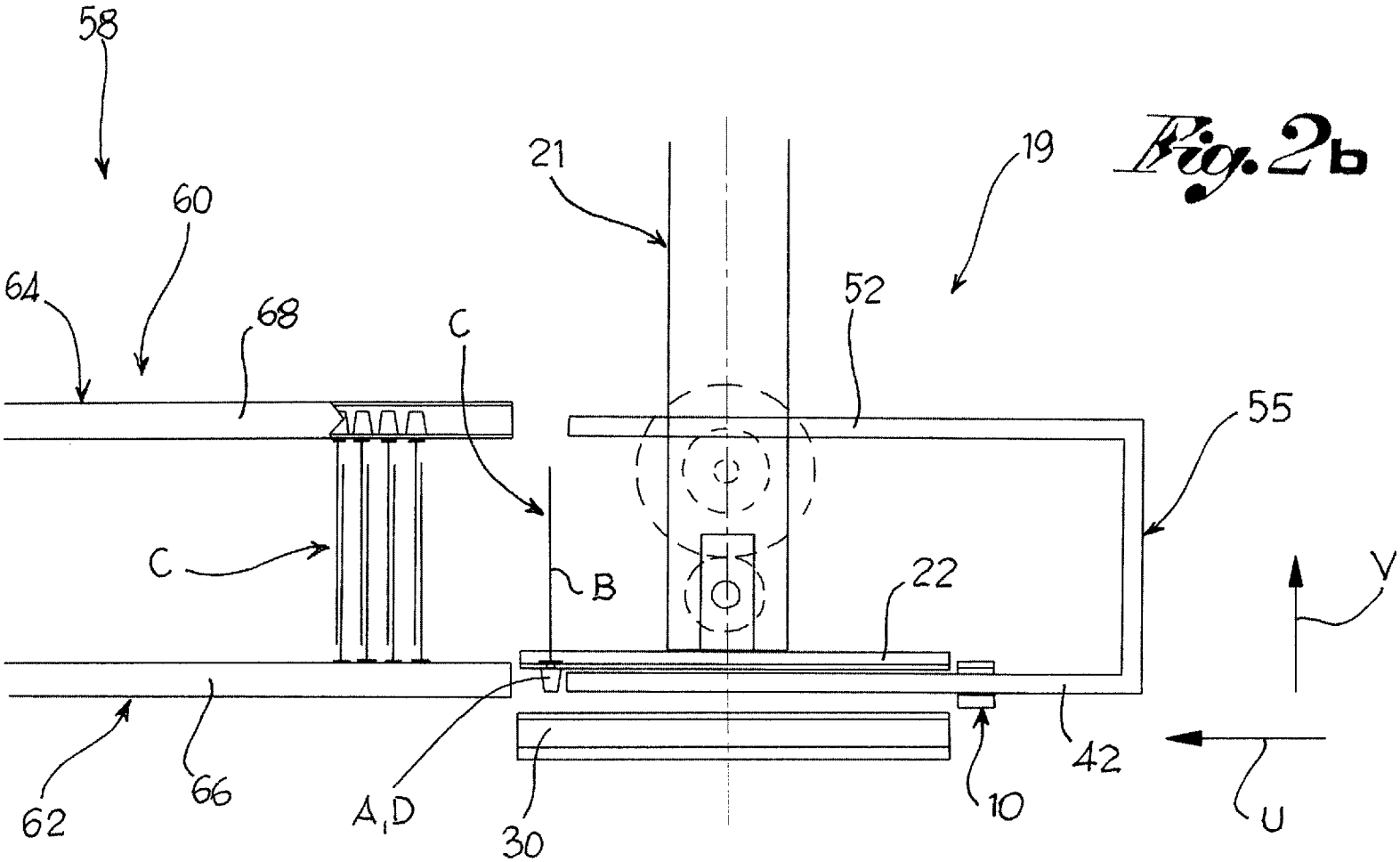
Figure 2C:
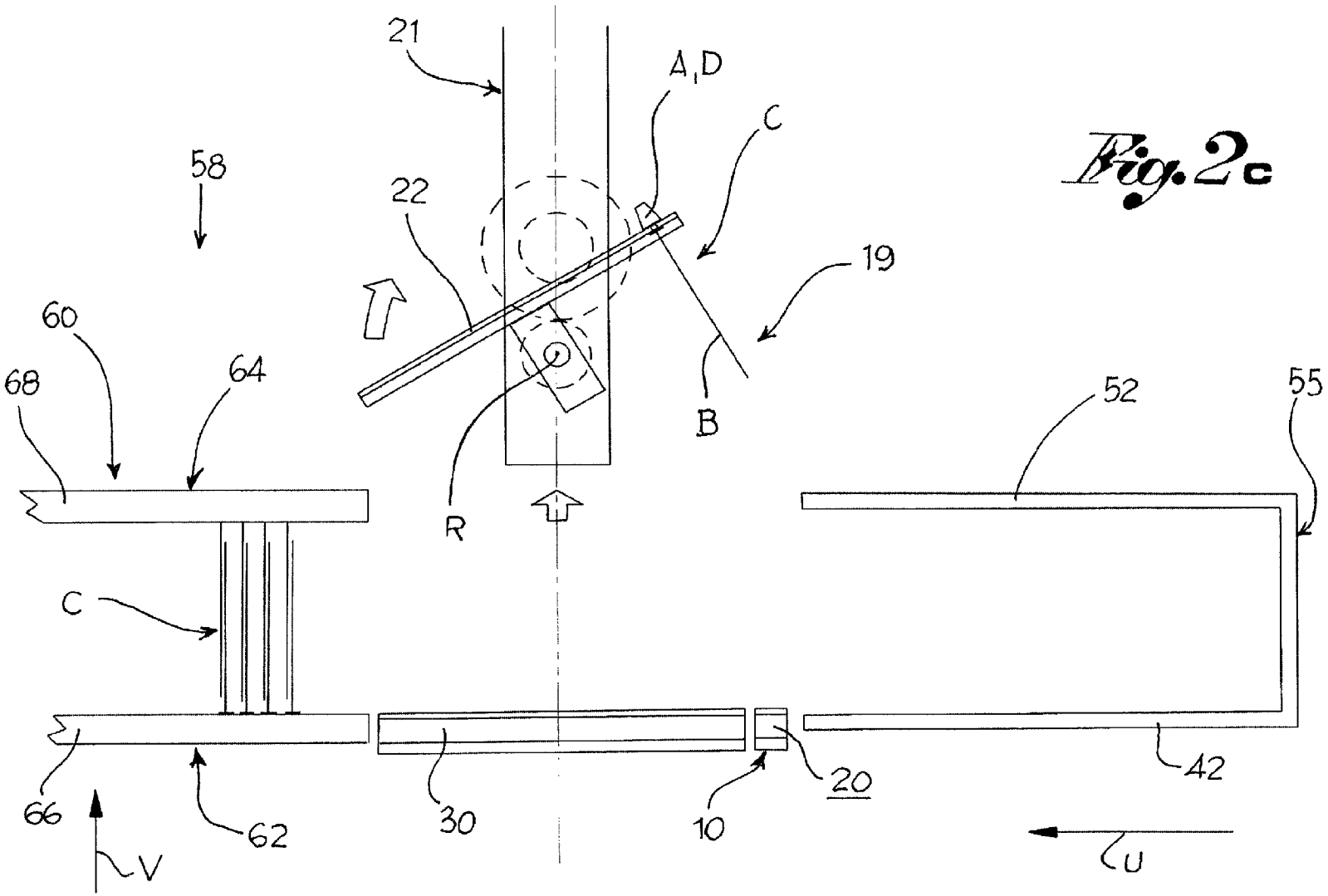

The intermediate station 19 comprises a tip-up unit 21 suitable to tip up the containers C to arrange them vertically upright, that is with the straw A facing upwards and the container downwards, as shown in FIG. 2*c*.

According to a preferred embodiment, the tip-up unit 21 comprises a plurality of tracks 22, shown in detail in FIGS. 3 and 4, which extend mainly in the unloading direction U and are positioned side by side along a transport direction T.

The tracks 22 are distanced along the transport direction T, so as to form an interspace 23 between these to hold the straw A.

In particular, the outline of the tracks 22, that is the shape of the cross-section obtained with a plane containing the transport direction T is such as to form a bilateral vertical restraint, such that when the straw A is held between the tracks, the containers cannot be extracted vertically, either upwards or downwards, as shown in FIGS. 3 and 4.

For example, the straw comprises two vertically distanced flanges, between which the tracks 22 are inserted, preventing the movement of the container downwards and upwards.

Figure 2D:
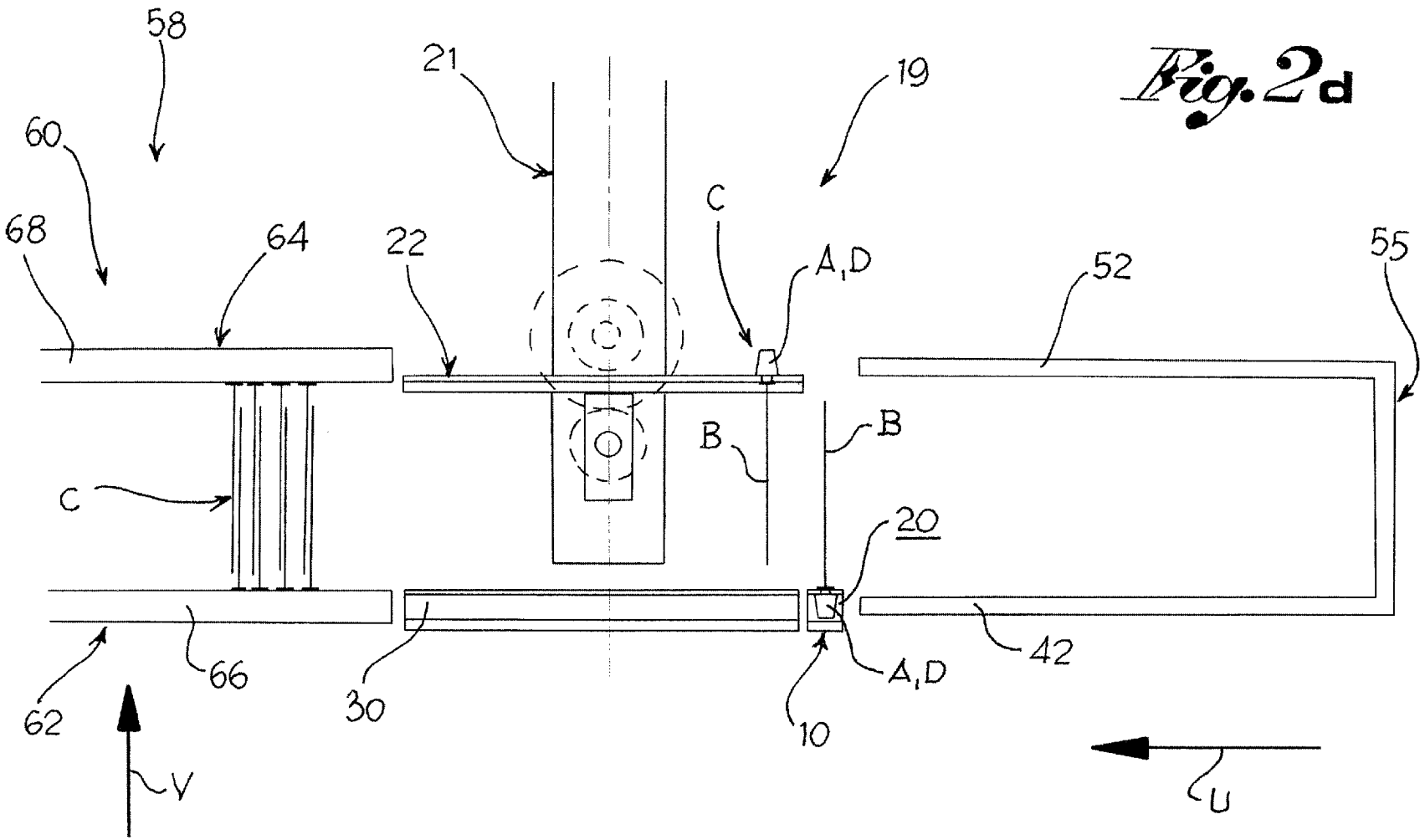

The tip-up unit 21 is suitable to pass from a loading configuration, in which it is suitable to receive the upside-down containers C brought by the chain 8, as shown in FIG. 2*b*, to an unloading configuration, in which the containers are hanging and upright, as shown in FIG. 2*d*.

In particular, in the loading configuration, the tracks 22 are aligned with the loading units 10 of the chain 8 along the unloading direction U; in particular, the loading compartments 20 of said loading units 10 are aligned along the unloading direction U with the tip-up interspaces 23 formed between the tracks 22, so as to form a single duct along said unloading direction U, as shown in FIG. 2*a*.

Moreover, in the loading configuration, the tracks 22 are at a lower height so that the loading compartments 20 of said loading units 10 are level with the tip up interspaces 23 formed between the tracks 22.

Figure 2E:
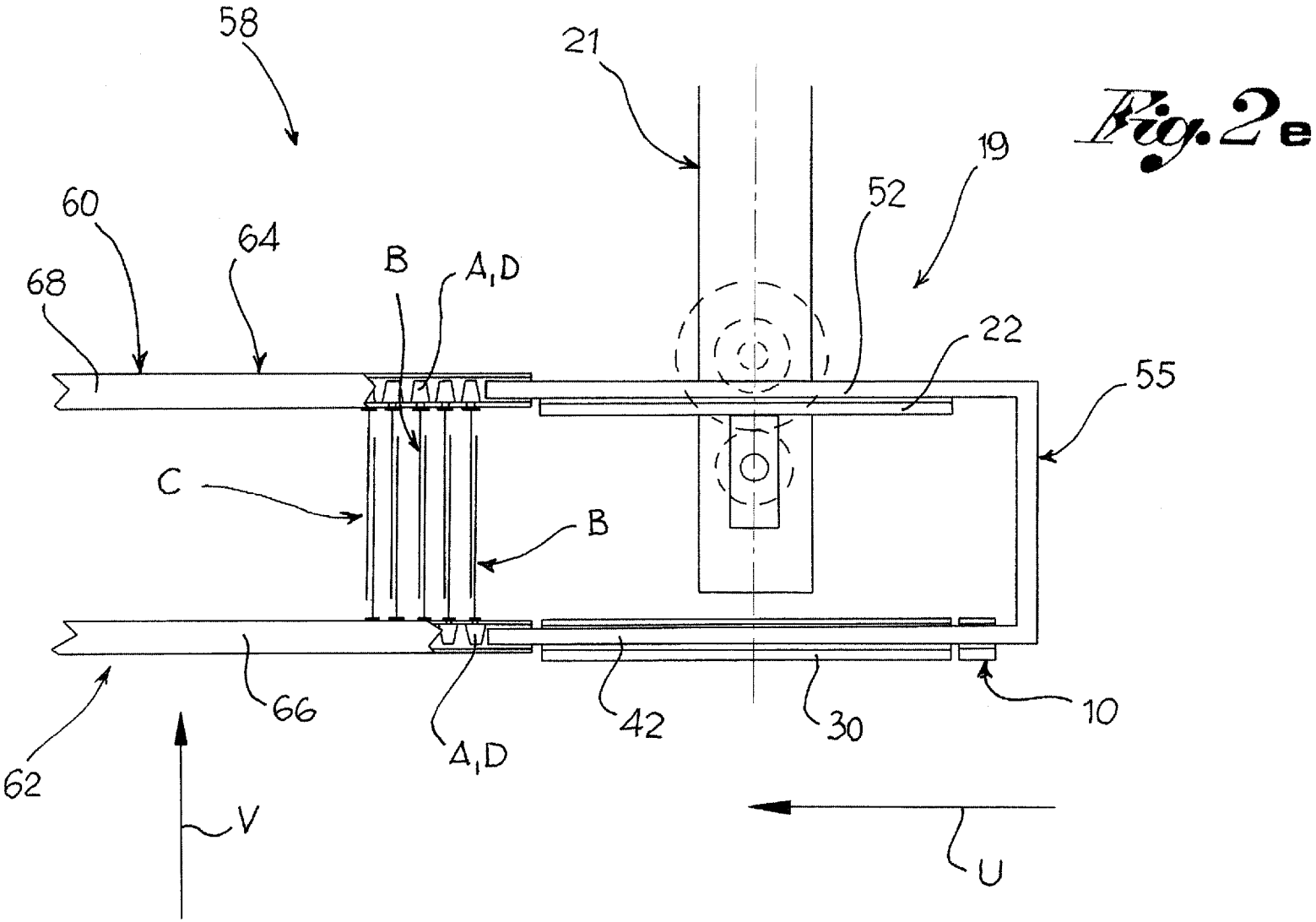

In the unloading configuration, the tracks are at a greater height, that is higher, and rotated around a rotation axis R parallel to the direction of advancement of the chain 8 along the transport direction T, as shown in FIGS. 2*d* and 2*e*.

Consequently, while in the loading configuration, the containers C are supported on the tracks 22, in the unloading configuration they hang from them.

Furthermore, the intermediate station 19 comprises auxiliary guides 30, shown in detail in FIG. 4, also suitable to receive the containers C.

The auxiliary guides 30 are suitable to pass from an active configuration, in which they are level with the chain 8 and aligned with it in the unloading direction U, as shown in FIG. 2*d*, to an inactive configuration, as shown in FIG. 2*b*.

The configurations which can be assumed by the tip-up unit 21 and by the auxiliary guides 30 are reciprocally correlated, in the sense that:

when the tip-up unit is in the loading configuration, the auxiliary guides are in the inactive configuration, as shown in FIG. 2*a*; and when the tip-up unit is in the unloading configuration, the auxiliary guides are in the active configuration, as shown in FIG. 2*d*.

In particular, the auxiliary guides 30 are replaceable in position with the tracks 22 of the tip-up unit, in the sense that when the tracks 22 leave the position assumed in the loading configuration, such position is occupied by the auxiliary guides and vice versa.

For example, in an embodiment, in the inactive configuration, the auxiliary guides 30 are positioned below the tracks 22 when these are in the position of the loading configuration, as shown in FIG. 2*b*.

When the tracks 22 leave the position of the loading configuration to adopt the position of the unloading configuration, the auxiliary guides move upwards and occupy the position previously occupied by the tracks 22 (active configuration of the auxiliary guides), as shown in FIG. 2*d*.

The packaging device further comprises movement means suitable to move a plurality of containers C from the transport means to the intermediate station 19.

According to an embodiment, said movement means comprise a first series of lower pushers 42 and a second series of upper pushers 52 (see FIGS. 2*a*-2*e*).

The pusher elements 42, 52 are elements elongated in the unloading direction U. Moreover, the pusher elements 42, 52 are arranged in pairs; the elements 42, 52 of each pair are vertically distanced; the lower elements 42 of the pairs and upper elements 52 of said pairs are distanced from each other in the transport direction T.

According to an embodiment, the lower pusher elements and the upper pusher elements are joined in movement and together make up a fork 55.

The first series is positioned at a lower height so that the relative pushers 42 are aligned horizontally with the loading compartments 20 of the chain 8 and with the tip-up interspaces 23 between the tracks 22 of the tip-up unit 21 in the position of the loading configuration (see FIG. 2*a*) and the auxiliary interspaces 32 between the auxiliary guides 30 in the position of the active configuration (see FIG. 2*d*).

The second series is positioned at a greater height, that is higher up, so that the relative pushers 52 are aligned horizontally with the tip-up interspaces 23 between the tracks 22 of the tip-up unit 21 in the position of the unloading configuration (see FIG. 2*d*).

The movement means have an unloading movement in the direction of the unloading axis U; in particular, the first series and second series of pushers 42, 52 have an outward and return movement in the direction of the unloading axis U, between a forward position (see FIGS. 2*b* and 2*e*), at the limit of the outward stroke, and a retracted position, at the limit of the return stroke (see FIGS. 2*a* and 2*d*).

Moreover, at least the lower series is provided with a double stroke movement, in other words able to perform a short stroke and a long stroke, according to the step of the packaging method as described above.

The packaging device further comprises an unloading area 58, positioned alongside the intermediate station 19, on the opposite side to the chain 8 (see FIG. 1).

In said unloading area 58, there is a loading box 60 suitable to receive a plurality of containers aligned in rows and columns.

The loading box is portable and is positioned at the intermediate station, on the opposite side to the chain 8.

The loading box 60, shown in detail in FIG. 6, comprises a lower surface 62 and an upper surface 64, distanced vertically, each made up of a succession of loading profiles 66, 68 extending mainly along the unloading direction U and positioned side by side along the transport direction T.

The profiles 66, 68 have a transversal cross-section, that is made with a vertical plane containing the transport direction T, in a "U" shape, to form a bilateral vertical restraint.

The profiles 66 of the lower surface 62 have the aperture of the section facing upwards; the profiles 68 of the upper surface 64 have the aperture of the section facing downwards, in other words facing the aperture of the section of the lower profiles.

The lower profiles 66 are aligned with the auxiliary interspaces 32 between the auxiliary guides 30 when these are up, in the active configuration; the upper profiles 68 are aligned with the tip-up interspaces 23 between the tracks 22 when these are up, in the position of the unloading configuration.

A packaging method which can be performed using the packaging device described above comprises a first step of loading upright containers, a second step of loading upside-down containers and a third step of unloading.

In an initial configuration of the packaging device, the tip-up unit 21 is in the loading configuration, that is the tracks 22 are down, level with the chain (see FIG. 2*a*).

The auxiliary guides 30 are in the inactive configuration, that is below the tracks 22.

The lower and upper pushers 42, 52 are in the rearward position.

The loading box is alongside the intermediate station so that the lower profiles 66 are level with the chain 8 and the upper profiles 68 level with the tracks 22 in the unloading configuration.

In the first loading step (loading of upright containers), the production device 2, which has produced a plurality of containers C, arranges a predefined number, such as thirteen or fifteen, on the chain 8, one for each loading unit 10, so that the straws occupy the respective loading compartment 20 of the loading unit 10. Said group of containers is called a "train".

The body B of the containers C is aligned along the transport axis T.

The chain 8 is moved so as to move along a transport axis T. The train of containers C is transported by the production device 2 to the packaging device.

The chain 8 stops so that the loading compartments 20 occupied by the train of containers C are aligned with the tip-up interspaces 23 between the tracks 22, below (see FIG. 2*a*).

The movement means are driven to move the containers C from the chain 8 to the intermediate area 19 in particular in the tip-up interspaces 23 between the tracks 22.

In particular, the pushers 42 are driven and brought from the rearward position to the forward position moving along the unloading axis U, so that the containers are pushed by the loading units 10 of the chain 8 to the tip-up interspaces 23 between the tracks 22 (see FIG. 2*b*).

The pushers 42 move by a short stroke and return to the rearward position.

The tip-up unit 21 tips the train of containers arranged in the tip-up interspaces 23 between the tracks 22.

In particular, the tracks 22 simultaneously perform a vertical movement upwards and rotating around the rotation axis R, overturning the train of containers C, as shown in FIG. 2*c*.

When the tracks 22 leave the position of the loading configuration, the auxiliary guides 30 take their place, moving into the position of the active configuration (see FIG. 2*d*).

The tracks 22 position themselves in the unloading configuration, in which they are higher up than the previous height, preferably still in the intermediate station 19, aligned with the upper pushers 52.

An intermediate configuration of the device is thus defined, wherein the tip-up unit 21 is in the unloading configuration, that is the tracks 22 are up, at the level of the upper pushers 52.

The auxiliary guides 30 are in the active configuration, so that the tip-up interspaces between them are aligned horizontally with the chain and with the lower pushers 42.

The pushers 42, 52 are in the rearward position.

In a second loading step (loading of upside-down containers), the production device 2, which has produced a plurality of containers C, arranges a predefined number of these on the chain 8, one for each loading unit 10, so that the straws A occupy the respective loading compartment 20 of the loading unit 10.

The body B of the containers C is aligned along the transport axis T.

The chain 8 is moved so as to move along a transport axis T. The train of containers C is transported by the production device 2 to the packaging device.

The chain 8 stops so that the loading compartments 20 occupied by the train of containers C are aligned with the auxiliary interspaces 32 between the auxiliary guides 30 (see FIG. 2*d*).

The movement means are driven to move the containers C from the chain 8 to the loading box 60, passing between the auxiliary guides 30, and contemporarily to drive the containers C hanging from the tracks 22 to the loading box 60 (see FIG. 2*e*).

In particular, the lower pushers 42 and upper pushers 52 are driven and brought from the rearward position to the forward position, moving along the unloading axis U by a long stroke, so that the containers C upside-down on the chain and the containers hanging from the tracks are pushed into the loading box 60.

The profiles 66 of the lower surface 62 of the loading box 60 receive the upside-down containers, coming from the chain, and the profiles 68 of the upper surface 64 receive the hanging containers, coming from the tracks.

After pushing the containers into the loading box 60, the pushers 42, 52 return to the rearward position.

The tip-up unit 21 returns to the load configuration, that is the tracks 22 return level with the chain and the auxiliary guides return to the inactive configuration, below the tracks.

The packaging method then recommences from the first loading step, until the loading box is full.

Once the loading box has been filled, the full box is replaced with an empty box.

The full box is then inserted in a rigid casing; the casing and box unit is tipped and wrapped in a protective sheet, such as polyethylene; preferably, the casing box and wrapped sheet is inserted in a box, such as cardboard box; the rigid casing is then extracted from the cardboard box, which is in turn closed and addressed for shipment.

The present disclosure fully achieves the predefined aim in an innovative manner, in that it makes it possible to considerably increase the number of containers which can be transported per unit of volume.

In particular, the present disclosure achieves the advantage of packing into a cardboard box almost double the number of containers compared to the prior art.

It is clear that a person skilled in the art may make modifications to the apparatus and method described above so as to satisfy contingent requirements all contained within the sphere of protection as defined by the appended claims.

What is claimed is:

1. A device for packing slim-bodied containers, comprising:

means for transporting a train of containers in a first vertically arranged upside down arrangement;

a tip-up unit having tip-up interspaces, suitable, in a load configuration, for accommodating in the tip-up interspaces the train of containers in a first arrangement and overturning it in a second standing up arrangement, moving to an unloading configuration;

auxiliary guides having auxiliary interspaces, suitable for accommodating, in an active configuration, an additional train of containers in the first arrangement, the auxiliary interspaces being aligned with the respective tip-up interspaces along an unloading direction;

an unloading area for accumulating the containers in rows; and movement means suitable for cooperating with the tip-up unit in the unloading configuration and with the auxiliary guides in the active configuration to move the containers towards the unloading area, moving along the unloading direction.

2. The device according to the claim 1, wherein the auxiliary guides are replaceable in position with the tip-up unit when the tip-up unit switches from a loading configuration to the unloading configuration.

3. The device according to the claim 1, wherein the tip-up unit comprises a plurality of tracks elongated in the unloading direction and distanced in a direction at right angles to the unloading direction, between the tracks being defined the tip-up interspaces, the tracks having a cross section such as to realise a bilateral vertical restraint for a straw of the container fitted in the tip-up interspace.

4. The device according to claim 1, wherein the tip-up unit is suitable for vertically moving and turning around a rotation axis at right angles to the unloading direction to tip up the containers.

5. The device according to claim 1, wherein the means for transporting comprise a chain suitable for moving forwards along a transport direction at right angles to the unloading direction.

6. The device according to the claim 5, wherein the chain includes a plurality of loading units each having a loading compartment that can be aligned with the respective tip-up interspace and auxiliary interspace along the unloading direction.

7. The device according to claim 1, wherein the movement means comprise a first series of pushers at a first level of the auxiliary interspaces in a position of the active configuration of the auxiliary guides and a second series of pushers at a second level of the tip-up interspaces in a position of the unloading configuration of the tip-up unit.

8. The device according to the claim 7, wherein the movement means are suitable for moving with a double stroke.

9. An apparatus comprising:

a device for packing slim-bodied containers, comprising:

means for transporting a train of containers in a first vertically arranged upside down arrangement;

a tip-up unit having tip-up interspaces, suitable, in a load configuration, for accommodating in the tip-up interspaces the train of containers in a first arrangement and overturning it in a second standing up arrangement, moving to an unloading configuration;

auxiliary guides having auxiliary interspaces, suitable for accommodating, in an active configuration, an additional train of containers in the first arrangement, the auxiliary interspaces being aligned with the respective tip-up interspaces along an unloading direction;

an unloading area for accumulating the containers in rows; and movement means suitable for cooperating with the tip-up unit in the unloading configuration and with the auxiliary guides in the active configuration to move the containers towards the unloading area, moving along the unloading direction; and a loading casing that can be housed in the unloading area and is portable.

10. The apparatus according to claim 9, wherein the loading casing comprises a lower surface vertically spaced from an upper surface, each made up of a succession of loading profiles extending along the unloading direction and positioned side by side along a direction at right angles to the unloading direction.

11. A method for packing slim-bodied containers comprising:

a first phase of loading containers in a second arrangement, wherein:

a) a chain containing containers in a first arrangement, contained in loading compartments, is moved so as to move along a transport axis;

b) the chain stops so the loading compartments occupied by the containers are aligned with tip-up interspaces between tracks of a tip-up unit;

c) means for moving containers are driven to move the containers from the chain into the tip-up interspaces;

d) the tip-up unit overturns a train of containers arranged in the tip-up interspaces in a second arrangement, aligning the tip-up interspaces with an upper surface of a loading box; and e) auxiliary guides take a place of the tip-up unit at the level of the chain;

a second loading phase of additional containers in the first arrangement, wherein:

f) the chain is moved to convey additional containers in the first arrangement;

g) the chain stops so the loading compartments occupied by the containers are aligned with the auxiliary interspaces between the auxiliary guides; and h) the means for moving containers are driven to move the containers in the first arrangement from the chain to an unloading area and the containers in the second arrangement from the tip-up unit to the unloading area.

* * * * *